US011078712B2

(12) United States Patent
Zhu et al.

(10) Patent No.: US 11,078,712 B2
(45) Date of Patent: Aug. 3, 2021

(54) AUTOMATIC FIRE DOOR CLOSING DEVICE AND SYSTEM

(71) Applicant: SUZHOU FUERDA TECHNOLOGY CO., LTD., Jiangsu (CN)

(72) Inventors: Like Zhu, Jiangsu (CN); Fei Nie, Jiangsu (CN)

(73) Assignee: SUZHOU FUERDA TECHNOLOGY CO., LTD., Suzhou (CN)

( * ) Notice: Subject to any disclaimer, the term of this patent is extended or adjusted under 35 U.S.C. 154(b) by 897 days.

(21) Appl. No.: 15/737,789

(22) PCT Filed: Nov. 30, 2015

(86) PCT No.: PCT/CN2015/095962

§ 371 (c)(1),
(2) Date: Dec. 19, 2017

(87) PCT Pub. No.: WO2017/020453

PCT Pub. Date: Feb. 9, 2017

(65) Prior Publication Data

US 2019/0003239 A1 Jan. 3, 2019

(30) Foreign Application Priority Data

Aug. 6, 2015 (CN) ..... 201510477433.0

(51) Int. Cl.
*E05F 3/20* (2006.01)
*E05F 15/72* (2015.01)
(Continued)

(52) U.S. Cl.
CPC ..... *E05F 15/72* (2015.01); *E05F 1/006* (2013.01); *E05F 3/22* (2013.01); *E05F 15/50* (2015.01); *E05Y 2900/132* (2013.01)

(58) Field of Classification Search
CPC ..... Y10T 16/22; Y10T 16/521; Y10T 16/56; E05F 15/72; E05F 15/70; E05F 15/71;
(Continued)

(56) References Cited

U.S. PATENT DOCUMENTS 2,043,198 A * 6/1936 Heverly ..... A62C 2/12 16/48.5
2,792,087 A * 5/1957 Pollack ..... A62C 2/12 16/48.5
(Continued)

FOREIGN PATENT DOCUMENTS

CN 1749518 3/2006
CN 202181785 4/2012
(Continued)

OTHER PUBLICATIONS

International Search report dated Apr. 28, 2016 from corresponding application No. PCT/CN2015/095962.

*Primary Examiner* — Chuck Y Mah
(74) *Attorney, Agent, or Firm* — Hauptman Ham, LLP

(57) ABSTRACT

An automatic fire door closing device includes a hydraulic main engine, an arm rod, a rotating shaft, a connecting plate and a clamping device, and further comprises a fire monitoring and response device and a driving device. The driving device includes a linkage rod rotatably connected to the connecting plate, a transmission column rotatably connected to the connecting plate, and a transmission rod fixedly connected to the transmission column, one end of the linkage rod has a hook part for hooking the transmission rod, and the transmission column cooperates with the clamping device, when smoke or open fire is monitored, the hook part of the linkage rod is disengaged from the transmission rod, and the rotation of the transmission column makes the clamping device to release the rotating shaft. The device
(Continued)

reduces cost with simple structure, high integration and low installation difficulty.

11 Claims, 4 Drawing Sheets

(51) Int. Cl.
*E05F 15/50* (2015.01)
*E05F 1/00* (2006.01)
*E05F 3/22* (2006.01)

(58) Field of Classification Search
CPC . E05F 15/50; E05F 1/006; E05F 1/002; E05F 3/22; E05Y 2900/132; E05Y 2900/134
See application file for complete search history.

(56) References Cited

U.S. PATENT DOCUMENTS 2,954,106 A * 9/1960 Schlage ..... A62C 2/12 16/48.5
3,147,830 A * 9/1964 Flint ..... E05F 3/221 16/48.5
3,875,612 A * 4/1975 Poitras ..... A62C 2/12 16/48.5
3,905,063 A * 9/1975 Coulter ..... A62C 2/12 16/48.5
3,934,306 A * 1/1976 Farris ..... E05F 3/223 16/48.5
3,964,125 A * 6/1976 Tansley ..... A62C 2/06 16/48.5
4,161,804 A * 7/1979 D'Hooge ..... A62C 2/12 16/48.5
4,715,146 A * 12/1987 Atsumi ..... E05B 47/0002 16/48.5
5,551,187 A * 9/1996 Brouwer ..... E05F 1/006 292/DIG. 66
6,092,334 A * 7/2000 Kim ..... E05F 1/006 16/334
6,891,479 B1 * 5/2005 Eccleston ..... E05F 15/63 116/86
7,610,719 B2 * 11/2009 Hsieh ..... F21S 4/28 362/249.09
10,030,426 B2 * 7/2018 Langenberg ..... E05F 15/619
2012/0140474 A1 * 6/2012 Jurik ..... F21S 4/28 362/249.09
2015/0128496 A1 5/2015 Phillips

FOREIGN PATENT DOCUMENTS

| | | | |
|---|---|---|---|
| CN | 102808562 | | 12/2012 |
| CN | 202788406 | | 3/2013 |
| CN | 203334861 | | 12/2013 |
| CN | 204139819 | | 2/2015 |
| CN | 204515967 | | 7/2015 |
| CN | 204782493 | | 11/2015 |
| EP | 2468992 | | 6/2012 |
| JP | 2012127167 | | 7/2012 |
| KR | 100567769 | B1 * | 4/2006 |
| KR | 101486167 | B1 * | 2/2015 |

* cited by examiner

AUTOMATIC FIRE DOOR CLOSING DEVICE AND SYSTEM

RELATED APPLICATIONS

The present application is a National Phase of International Application Number PCT/CN2015/095962, filed Nov. 30, 2015, and claims the priority of China Application No. 201510477433.0, filed Aug. 6, 2015.

TECHNICAL FIELD OF THE INVENTION

The present disclosure relates to an automatic fire door closing device and a system.

BACKGROUND OF THE INVENTION

Door closers are devices that can automatically close an open door through springs and hydraulic devices. At present, there are two types of door closers, one of which is a normally closed type door closer that cannot open a door to a stop keep position, another of which is a door closer with positioning, which that can keep a door in an open state after opening the door, and is more conducive to human walking and ventilation.

Wherein, in order to prevent the entry of smoke and fires in the event of a fire, the door closer with positioning need to be closed immediately, and at present, there are mainly the following two techniques:

I. Electromagnetic door holder: this device utilizes electromagnetic principle, and consists of electromagnet consisting of an electromagnetic coil, and a holder plate. The electromagnetic door holder will automatically suck the door to position it when pushing the door, without manual operation; when a fire happens, the power supply is cut off to achieve automatic close of the fire door. However, this product has no signal feedback function, is directly powered by the firefighting circuit, occupies firefighting power source capacity, and is in a standby state with a great power dissipation all the year round. It has no fault protection function due to the function is too simple, and may cause fire hazards once short circuit fault occurs in the coils.

II. Electromagnetic tripping device: it comprises an electromagnetic releaser and a lock catch. It needs no electricity at ordinary times, and the trip needs to be manually inserted into the electromagnetic release when the door is opened to be positioned, and will be released by powering on when in the event of a fire. The fire door will be automatically closed under the action of an ordinary door closer, however, will not be automatically reset when being used again, and needs to be reset manually. Due to that there are many mechanical structures inside, quality defects may often occur because such as the plectrum, the connecting rod, the lock catch and the like are easy to deform or jam. Further, it is eliminated by the market gradually due to closing the door by being powered on is not conformity with fire protection rules.

In additional, they also needs to be networked with the fire protection system, and this increases the difficulty in the design of construction, construction and wiring during installing the facilities, and the fitting cost also is high.

SUMMARY OF THE INVENTION

The purpose of the present disclosure is to provide an automatic fire door closing device and a system, which may close the door timely when a fire is monitored.

To achieve the above mentioned purpose, the technical scheme employed by the present disclosure is:

An automatic fire door closing device, comprising a door closer body for fixing on the door to close the door, an arm rod rotatably driven by the door closer body, a connecting plate for connecting with a door frame, and a clamping device capable of keeping the door open after being opened, the arm rod and the connecting plate being rotatably connected via a rotating shaft, one of the arm rod and the connecting plate being provided with the clamping device and the other one being fixedly connected with the rotating shaft; the automatic fire door closing device further comprises a fire monitoring and response device, and a driving device cooperating with the fire monitoring and response device and the clamping device;

the driving device comprises a transmission column rotatably connected to the arm rod or the connecting plate, a transmission rod connected to the transmission column, and a linkage rod rotatably connected to the arm rod or the connecting plate and rotating in response to the fire monitoring and response device. The transmission column and the clamping device are connected to drive the clamping device to prop against or release the rotating shaft. One end of the linkage rod has a hook part. When the door is in an open state, the hook part of the linkage rod hooks the transmission rod. And when the fire monitoring and response device detects smoke or open fire, the hook part of the linkage rod is disengaged from the transmission rod, the transmission column is released so as to allow the rotation of the rotating shaft, and the arm rod and the connecting plate draw close to each other.

In one or more embodiments, the fire monitoring and response device comprises a smoke monitoring device. The smoke monitoring device comprises a smoke monitor and an electromagnet mounted on the arm rod or the connecting plate. The smoke monitor is electrically connected to the electromagnet, the electromagnet has a spring that may deform with its magnetic changes, and the linkage rod is connected with the spring to rotate along with the spring deformation. When the smoke monitor detects smoke, the electromagnet is energized, the spring is compressed, the electromagnet and one end of the linkage rod move closer or away, and the hook portion is disengaged from the transmission rod.

In one or more embodiments, the fire monitoring and response device comprises an open fire monitoring device. The open fire monitoring device comprises a connecting rod with one end rotatably connected to the arm rod or the connecting plate, a fire glass ball provided between the other end of the connecting rod and the arm rod or the connecting plate, and a driving elastic member with elastic deformation connected between the other end of the connecting rod and the arm rod or the connecting plate. When the open fire monitor detects open fires, the fire glass ball is broken, the driving elastic member is reset, and the connecting rod presses the linkage rod tightly to disengage the hook from the transmission rod.

In one or more embodiments, the fire monitoring and response device comprises a smoke monitoring device and an open fire monitoring device.

The linkage rod is rotatably connected to the connecting plate via a first pivot shaft, and has a first end and a second located at two sides of the first pivot shaft, respectively, and the hook part is formed at the first end of the linkage rod.

The smoke monitoring device comprises a smoke monitor and an electromagnet fixed on the connecting plate. The smoke monitor is electrically connected to the electromagnet, the linkage rod is rotatably connected to the connecting plate via a first pivot shaft and has a first end and a second located at two sides of the first pivot shaft, respectively, and the hook part is formed at the first end of the linkage rod. The electromagnet has a spring, the spring and the linkage rod are connected together. When the smoke monitor detects smoke, the electromagnet is energized, the spring is compressed, the electromagnet and the second end of the linkage rod move closer, and the hook portion is disengaged from the transmission rod.

The open fire monitoring device comprises a connecting rod, a fire glass ball and a driving elastic member. The connecting rod has a first end and an opposite second end. The first end of the connecting rod is rotatably connected to the connecting plate via a third pivot shaft, the fire glass ball and the driving elastic member are connected between the second end of the connecting rod and the connecting plate, and the first end of the linkage rod passes between the connecting rod and the connecting plate. When the open fire monitor detects open fires, the fire glass ball is broken, the driving elastic member is reset, and the connecting rod presses the linkage rod tightly to disengage the hook from the transmission rod.

Wherein, the axis of the first pivot shaft, the axis of a second pivot shaft, and the axis of the third pivot shaft are perpendicular to each other.

In one or more embodiments, the transmission column is rotatably connected to the connecting plate via a second pivot shaft. The transmission column has at least a first contact point and a second contact point which are in propping-against contact with the clamping device respectively, and the distance between the first contact point and the axis of the second pivot shaft is greater than the distance between the second contact and the axis of the second pivot shaft. When the transmission column contacts with the clamping device through the first contact point, the clamping device props against the rotating shaft; and when the transmission column contacts with the clamping device through the second contact point, the clamping device releases the rotating shaft.

In one or more embodiments, the cross section of the transmission column perpendicular to the axis of the second pivot shaft is a rectangle, the second pivot shaft passes through the center of the rectangle, the first contact point is located on a vertex of the rectangle, and the second contact point is located on one of the sides of the rectangle.

In one or more embodiments, the clamping device comprises a force adjusting spring and a steel ball connected with one end of the force adjusting spring for propping against the rotating shaft. The other end of the force adjusting spring is in propping-against contact with the transmission column.

In one or more embodiments, the rotating shaft is fixedly sleeved with a clamping plate which is provided with a notch thereon, and the steel ball is stuck within the gap when the door is in the open state.

In one or more embodiments, the automatic fire door closing device further comprises a state monitoring device for monitoring the opening and closing of the door. The state monitoring device comprises a position monitor fixed on the connecting plate, a push rod connected to the position monitor at one end thereof, and a linkage ring sleeved on the rotation shaft, the other end of the push rod has a convex portion, the outer peripheral surface of the linkage ring is opened with a recess, and when the convex portion is located within the recess, the door is opened and in a stop position state.

Another technical scheme employed by the present disclosure is:

An automatic fire door closing system, comprises a plurality of said automatic fire door closing devices and a central control room. The fire monitoring and response devices and the state monitoring devices of the plurality of automatic fire door closing device is in communication with the central control room, and the central control room is configured to receive open/close state signals of each door sent out by respective state monitoring devices and send driving signals to respective fire detectors, and such that the clamping device releases the rotating shaft.

Due to the use of the above mentioned technical schemes, the present disclosure has the following advantages over the prior art:

In the present disclosure, the fire monitoring and response device is integrated on the connecting plate of the existing door closers, and the cost of upgrading the existing products through a driving device with a simple structure is greatly reduced; in use, the device can timely give a feedback of the fire and control the door to close, and in daily use, the power consumption is just the electric energy consumed by device while it is monitoring the temperature change, the product cost and the daily usage cost are significantly reduced, and the device has a simple structure, high integration and significantly reduced difficulty in installation.

Wherein, 1—connecting plate; 2—arm rod; 3—rotating shaft; 4—clamping device; 40—force adjusting spring; 41—steel ball; 5—smoke monitoring device; 50—electromagnet; 6—open fire monitoring device; 60—connecting rod; 61—fire glass ball; 62—spring; 7—driving device; 70—linkage rod; 700—hook part; 71—transmission column; 72—transmission rod; 9—clamping plate; 90—notch; 10—state monitoring device; 100—position monitoring device; 101—push rod; 1010—convex portion; 102—linkage ring; 1020—recess.

DETAILED DESCRIPTION OF EXEMPLARY EMBODIMENTS

In the following, embodiments of the present disclosure are further described combining with the accompanying drawings.

Figure 1:
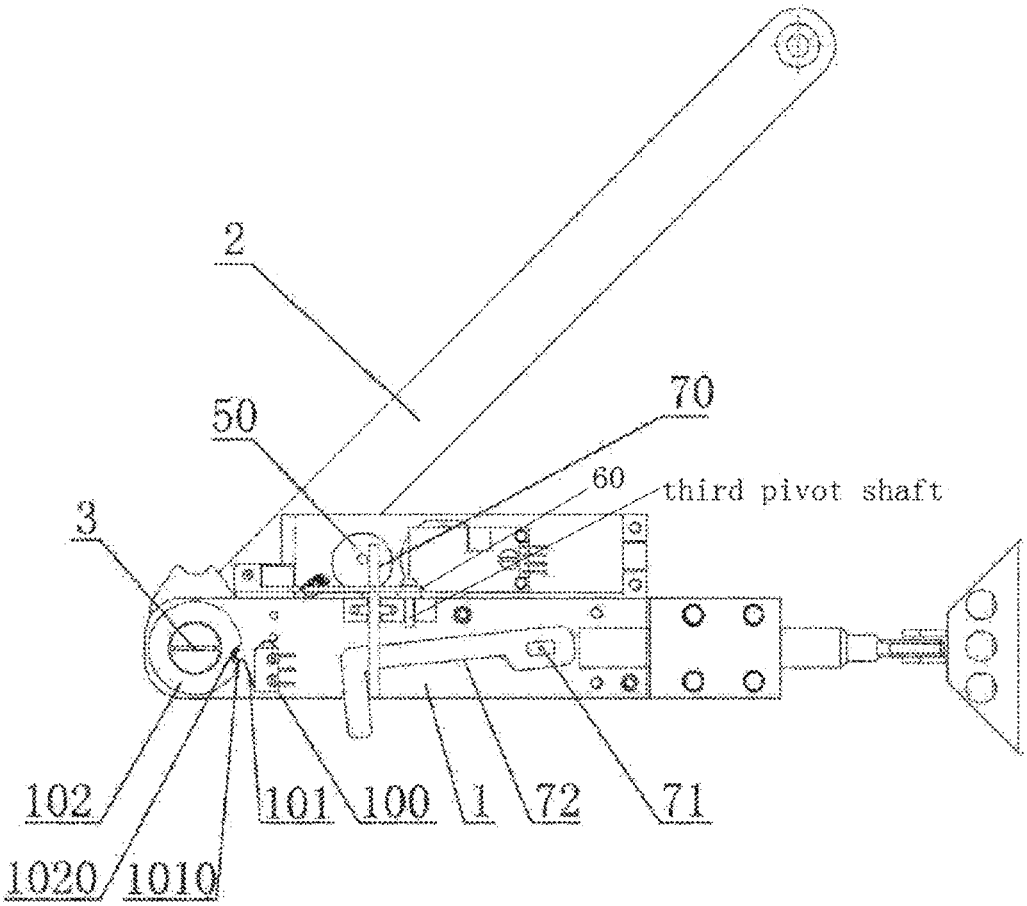
FIG. 1 is a main view of the present embodiment.
Figure 2:
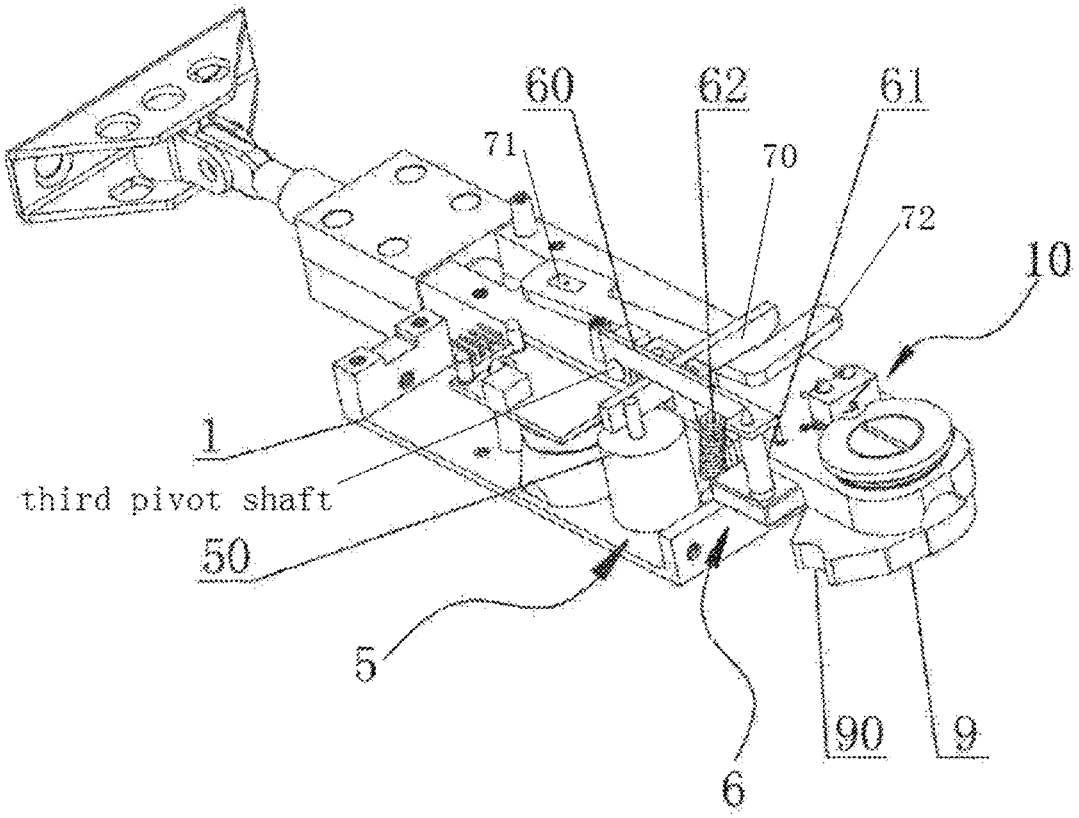
FIG. 2 is a schematic partial structure diagram I of the present embodiment.
Figure 3:
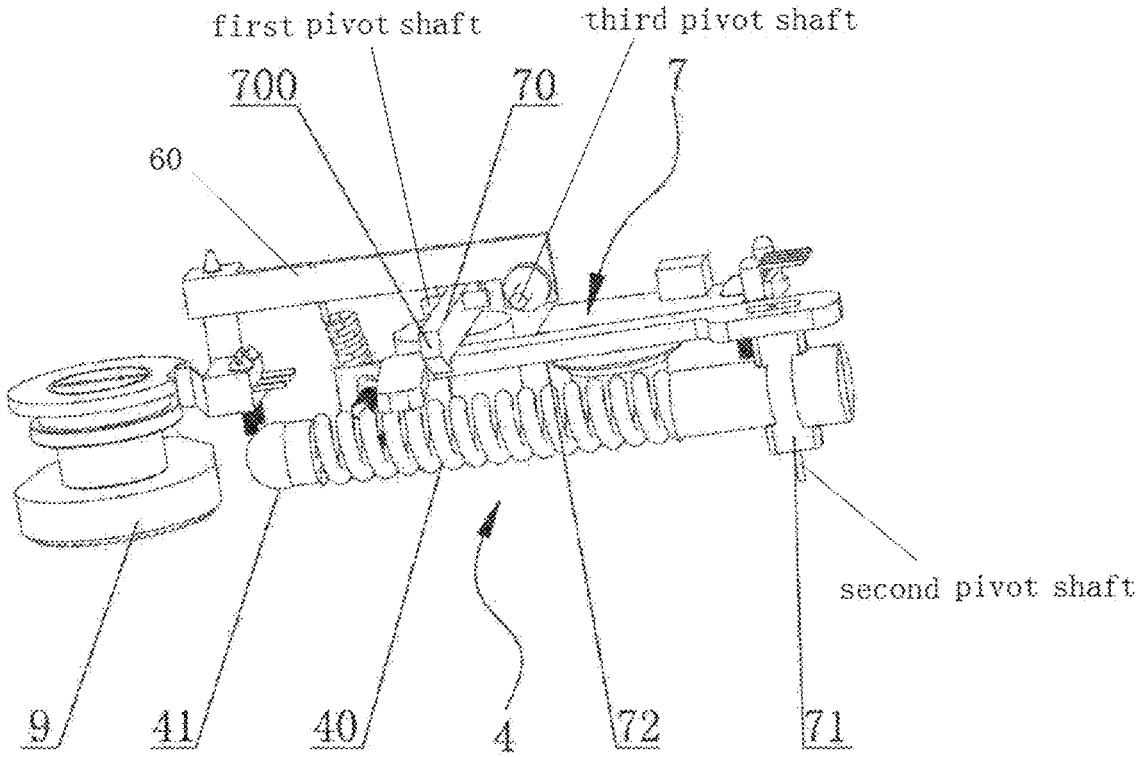
FIG. 3 is a schematic partial structure diagram II of the present embodiment.
Figure 4:
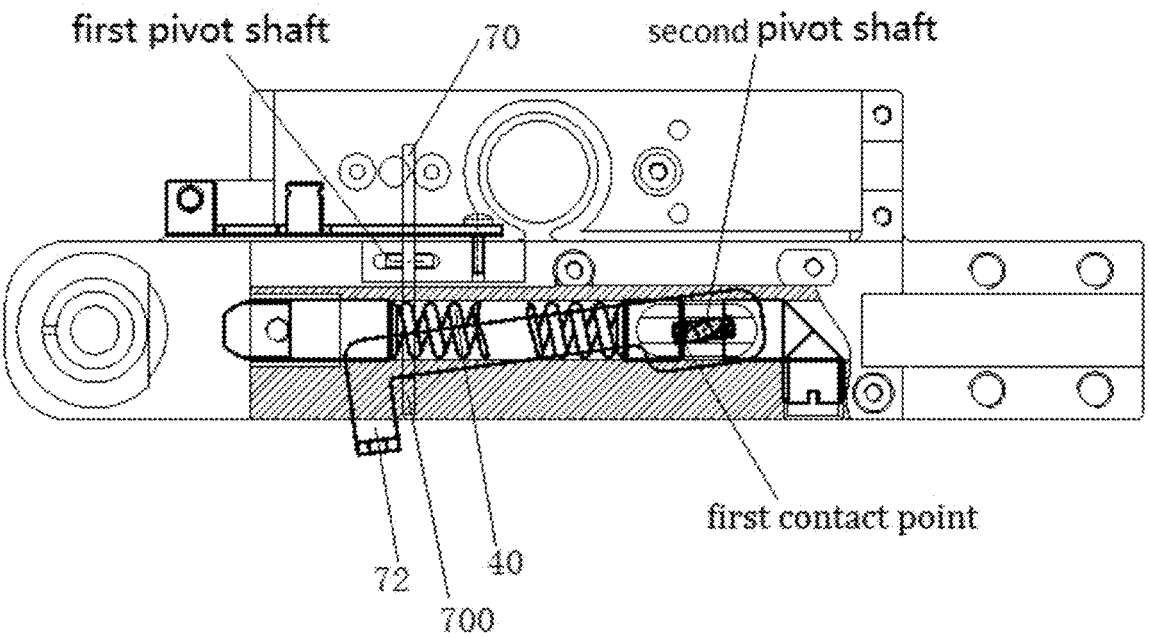
FIG. 4 is a schematic diagram of the present embodiment.
Figure 5:
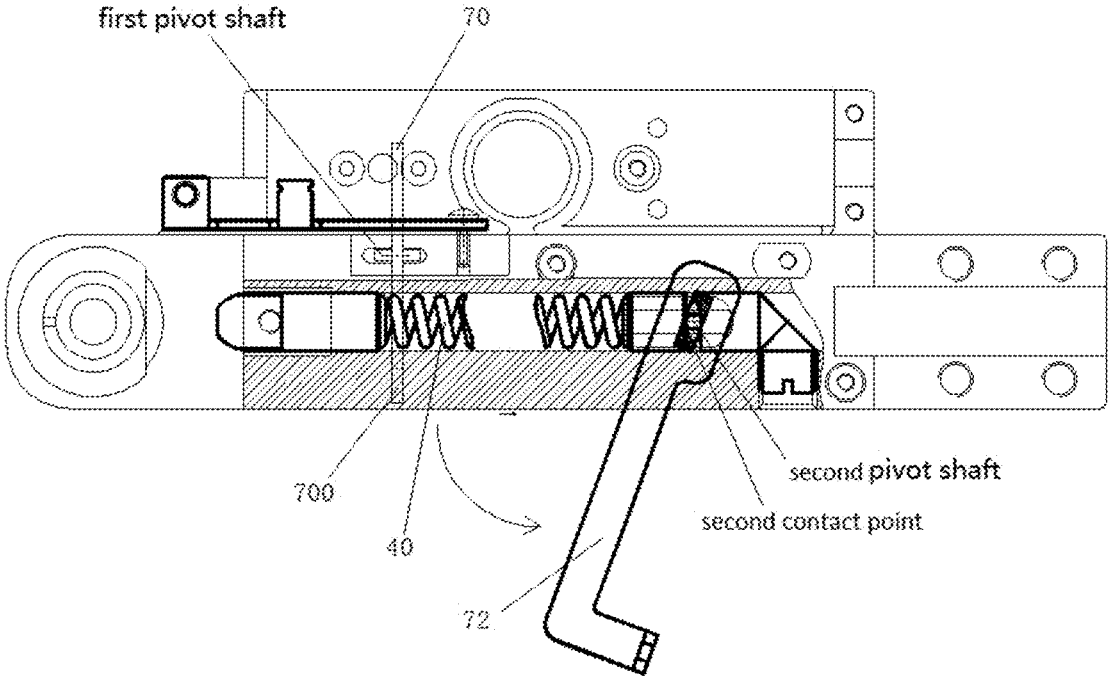
FIG. 5 is a schematic diagram of the present embodiment.

FIGS. 1-3 show an automatic fire door closing device. Combining with FIG. 1, the automatic fire door closing device comprises a door closer body for fixing on the door to drive the door to close automatically, an arm rod 2 connected with the door closer body at one end thereof and rotatably driven by the door closer body, a rotating shaft 3 fixedly connected with other end of the arm rod 2, a connecting plate 1 fixedly connected with a door frame at one end thereof and rotatably connected with the rotating shaft 3 at the other end thereof, and a clamping device 4 mounted on the connecting plate 1. The door closer body further comprises a hydraulic door closing mechanism. The connecting plate 1 and the arm rod 2 rotate with respect to the rotating shaft 3 when opening and closing the door, and the clamping device 4 can clamp the rotating shaft 3 tightly to keep the door in an open state when the door is in an opening stop position.

Combining with FIG. 2, the automatic fire door closing device further comprises a fire monitoring and response device, and a driving device cooperating with the fire monitoring and response device and the clamping device. In the present embodiment, the fire monitoring and response device comprises a smoke monitoring device 5 for monitoring smoke and an open fire monitoring device 6 for monitoring open fires mounted on the connecting plate 1. When a fire is detected, the driving device 7 drives the clamping device 4 to release the rotating shaft 3 so as to close the door.

The driving device 7 comprises a linkage rod 70 rotatably connected to the connecting plate 1 via a first pivot shaft, a transmission column 71 rotatably connected to the connecting plate 1 via a second pivot shaft, and a transmission rod 72 fixedly connected to the transmission column 71. The axis of the first pivot shaft and the axis of a second pivot shaft are perpendicular to each other, and the linkage rod has a first end and a second located at two sides of the first pivot shaft, respectively. The first end of the linkage rod has a hook part 700. The transmission column is connected with the clamping device to drive the clamping device to prop against or release the rotating shaft.

The clamping device 4 comprises a force adjusting spring 40, a steel ball 41 connected with one end of the force adjusting spring 40. The rotating shaft 3 is fixedly sleeved with a clamping plate 9, and the clamping plate 9 is provided with a notch 90 thereon cooperating with the steel ball 41. The transmission column 71 has at least a first contact point and a second contact point which are in propping-against contact with the force adjusting spring 40 respectively, and the distance between the first contact point and the axis of the second pivot shaft is greater than the distance between the second contact and the axis of the second pivot. When the transmission column 71 contacts with the force adjusting spring 40 through the first contact point, the pressure on the force adjusting spring 40 is large (or up to the limiting pressure), the steel ball 41 is clamped within the notch 90, the rotating shaft 3 is propped against such that the arm rod 2 and the connecting plate 1 cannot get close to each other, and the door is positioned in the open state. When the transmission column 71 contacts with the force adjusting spring 40 through the second contact point, and due to that the distance between the second contact point and the rotating shaft 3 is larger, the force adjusting spring 40 is decompressed, the steel ball 41 releases the rotating shaft 3, the arm rod 2 is rotatably driven by the door closer body and gets close to the connecting plate 1, achieving closing of the door. Specifically in the present embodiment, the cross section of the transmission column 71 perpendicular to the axis of the second pivot shaft is a rectangle, the second pivot shaft passes through the center of the rectangle, the first contact point is located on a vertex of the rectangle, and the second contact point is located on one of the sides of the rectangle.

When the door is in the open state, the hook part 700 of the linkage rod 70 hooks the transmission rod 72, and the transmission column 71 keeps still, and be propped against tightly with the force adjusting spring via the first contact point and such that the steel ball 41 props against the rotating shaft 3 tightly. When an open fire is detected, the linkage rod 70 rotates such that the first end thereof turns upwards, the hook part 700 is disengaged from the transmission rod 72, the force adjusting spring is decompressed, the transmission column 71 rotates until it is in a propping-against contact with the force adjusting spring 40 via the second contact point, and the rotating shaft 3 is released.

The smoke monitoring device 5 comprises a smoke monitor and an electromagnet 50 fixed on the connecting plate 1 and electrically connected to the smoke monitor. The smoke monitor may be disposed within a room or on the door, the number of which may be one or more, and the smoke monitor is connected to the electromagnet 50 via signals. The electromagnet 50 has a spring whose deformation quantity changes when the magnetism of the electromagnet 50 varies due to powering on or off, and the spring is connected to the second end of the linkage rod 70. When smoke is detected, the electromagnet 50 is powered on, and under the action of the magnetic force, the spring is compressed, the second end of the linkage rod 70 gets close to the electromagnet, and the linkage rod 70 takes the first pivot shaft as a turning point so that the first end of the linkage rod 70 turns upwards. Additionally, a reset spring with elastic deformation is provided between the first end of the linkage rod 70 and the electromagnet 50, and is a compressed spring. When the electromagnet 50 is powered off, the linkage rod 70 is reset under the action of the elastic reset force of the reset spring such that the hook part 700 hooks the transmission rod 72.

The open fire monitoring device 6 comprises a connecting rod 60, a fire glass ball 61 for sensing open fires, and a driving spring 62. The connecting rod 60 has a first end and an opposite second end, the first end of the connecting rod 60 is rotatably connected to the connecting plate 1 via a third pivot shaft, the axis of the third pivot shaft and the axis of the first pivot shaft are perpendicular, that is, the axis of the first pivot shaft, the axis of a second pivot shaft, and the axis of the third pivot shaft are perpendicular to each other, the fire glass ball 61 and the driving spring 62 are connected between the second end of the connecting rod 60 and the connecting plate 1, the reset spring 62 is a tension spring, and the second end of the linkage rod 70 passes between the connecting rod 60 and the connecting plate 1. When open fires are detected, the fire glass ball 61 is broken, and the connecting rod 60 gets close to the connecting plate 1 by the elastic reset force of the driving spring 62, and presses the second end of the linkage rod 70 toward the connecting plate, meanwhile the linkage rod 70 rotates, and the first end turns upwards.

The connecting plate 1 is opened with an installation space within which the clamping device 4 and the transmission column 71 are provided.

The automatic fire door closing device further comprises a state monitoring device 10 for monitoring the open and closed states of the door. The state monitoring device 10 comprises a position monitor 100 fixed on the connecting plate 1, a push rod 101 connected to the position monitor 100 at one end thereof, and a linkage ring 102 sleeved on the rotation shaft 3. The other end of the push rod 101 has a cambered convex portion 1010, the outer peripheral surface of the linkage ring 102 is opened with a recess 1020, and when the convex portion 1010 is located within the recess 1020, the door is opened and in a stop position state.

A plurality of automatic fire door closing devices forms an automatic fire door closing system. The automatic fire door closing system further comprises a central control room in communication with the smoke monitoring device 5, the open fire monitoring device 6 and the state monitoring device 10. The respective state monitoring device 10 sends open/close state signals of corresponding door to the central control room to acquire the open/close state of each door in fire; the signals among the plurality of automatic fire door closing devices may be series connected, and by sharing communication signals, the central control room emits driving signals to the smoke monitor 5 according to the open/close state signals of the doors, and drives one or more electromagnets 50 of the automatic fire door closing devices. Such that when a fire is detected in one place within one building, the doors in the whole building are all closes to prevent the spread of smoke and open fires.

The embodiments described above are only for illustrating the technical concepts and features of the present invention, are intended to make those skilled in the art being able to understand the present invention and thereby implement it, and should not be concluded to limit the protective scope of this invention. Any equivalent variations or modifications according to the present invention should be covered by the protective scope of the present invention.

What is claimed is:

1. An automatic fire door closing device, comprising a door closer body for fixing on the door to close the door, an arm rod rotatably driven by the door closer body, a connecting plate for connecting with a door frame, and a clamping device capable of keeping the door open after being opened, the arm rod and the connecting plate being rotatably connected via a rotating shaft, one of the arm rod and the connecting plate being provided with the clamping device and the other one being fixedly connected with the rotating shaft, wherein, the automatic fire door closing device further comprises a fire monitoring and response device, and a driving device cooperating with the fire monitoring and response device and the clamping device;

the driving device comprises a transmission column rotatably connected to the connecting plate, a transmission rod connected to the transmission column, and a linkage rod rotatably connected to the connecting plate and rotating in response to the fire monitoring and response device; the transmission column and the clamping device are connected to drive the clamping device to prop against or release the rotating shaft; one end of the linkage rod has a hook part which hooks the transmission rod when the door is in an open state, and disengages from the transmission rod when the fire monitoring and response device detects smoke or open fire, and the transmission column is released to allow the rotation of the rotating shaft, and the arm rod and the connecting plate draw close to each other.

2. The automatic fire door closing device according to claim 1, wherein, the fire monitoring and response device comprises a smoke monitoring device, the smoke monitoring device comprises a smoke monitor and an electromagnet, wherein the electromagnet is mounted on the connecting plate, and the smoke monitor is electrically connected to the electromagnet, the electromagnet has a spring that may deform with its magnetic changes, the linkage rod is connected with the spring to rotate along with the spring deformation, and when the smoke monitor detects smoke, the electromagnet is energized, the spring is compressed, the electromagnet and one end of the linkage rod move closer, and the hook portion is disengaged from the transmission rod.

3. The automatic fire door closing device according to claim 1, wherein, the fire monitoring and response device comprises an open fire monitoring device, the open fire monitoring device comprises a connecting rod with one end rotatably connected to the connecting plate, a fire glass ball provided between the other end of the connecting rod and the arm rod or the connecting plate, and a driving elastic member with elastic deformation connected between the other end of the connecting rod and the connecting plate, and when the open fire monitor detects open fires, the fire glass ball is broken, the driving elastic member is reset, and the connecting rod presses the linkage rod tightly to disengage the hook from the transmission rod.

4. The automatic fire door closing device according to claim 1, wherein, the fire monitoring and response device comprises a smoke monitoring device and an open fire monitoring device;

the linkage rod is rotatably connected to the connecting plate via a first pivot shaft, and has a first end and a second located at two sides of the first pivot shaft, respectively, and the hook part is formed at the first end of the linkage rod;

the smoke monitoring device comprises a smoke monitor and an electromagnet fixed on the connecting plate, the smoke monitor is electrically connected to the electromagnet, the linkage rod is rotatably connected to the connecting plate via the first pivot shaft and has a first end and a second located at two sides of the first pivot shaft, respectively, and the hook part is formed at the first end of the linkage rod; the electromagnet has a spring, the spring and the linkage rod are connected together, and when the smoke monitor detects smoke, the electromagnet is energized, the spring is compressed, the electromagnet and the second end of the linkage rod move closer, and the hook portion is disengaged from the transmission rod;

the open fire monitoring device comprises a connecting rod, a fire glass ball and a driving elastic member, the connecting rod has a first end and an opposite second end, the first end of the connecting rod is rotatably connected to the connecting plate via a third pivot shaft, the fire glass ball and the driving elastic member are connected between the second end of the connecting rod and the connecting plate, the first end of the linkage rod passes between the connecting rod and the connecting plate, and when the open fire monitor detects open fires, the fire glass ball is broken, the driving elastic member is reset, and the connecting rod presses the linkage rod tightly to disengage the hook from the transmission rod.

5. The automatic fire door closing device according to claim 4, wherein the transmission column is rotatably connected to the connecting plate via a second pivot shaft, and the axis of the first pivot shaft, the axis of the second pivot shaft, and the axis of the third pivot shaft are perpendicular to each other.

6. The automatic fire door closing device according to claim 1, wherein, the transmission column is rotatably connected to the connecting plate via a second pivot shaft, the transmission column has at least a first contact point and a second contact point which are in propping-against contact with the clamping device respectively, and the distance between the first contact point and the axis of the second pivot shaft is greater than the distance between the second contact point and the axis of the second pivot shaft, and when the transmission column contacts with the clamping device through the first contact point, the clamping device props against the rotating shaft; and when the transmission column contacts with the clamping device through the second contact point, the clamping device releases the rotating shaft.

7. The automatic fire door closing device according to claim 6, wherein, the cross section of the transmission column perpendicular to the axis of the second pivot shaft is a rectangle, the second pivot shaft passes through the center of the rectangle, the first contact point is located on a vertex of the rectangle, and the second contact point is located on one of the sides of the rectangle.

8. The automatic fire door closing device according to claim 6, is wherein, the clamping device comprises a force adjusting spring, and a steel ball connected with one end of the force adjusting spring for propping against the rotating shaft, the other end of the force adjusting spring is in propping-against contact with the transmission column.

9. The automatic fire door closing device according to claim 8, wherein, the rotating shaft is fixedly sleeved with a clamping plate, the clamping plate is provided with a gap, and the steel ball is stuck within the gap when the door is in the open state.

10. The automatic fire door closing device according claim 1, wherein, the automatic fire door closing device further comprises a state monitoring device for monitoring the opening and closing of the door, the state monitoring device comprises a position monitor fixed on the connecting plate, a push rod connected to the position monitor at one end thereof, and a linkage ring sleeved on the rotation shaft, the other end of the push rod has a convex portion, the outer peripheral surface of the linkage ring is opened with a recess, and when the convex portion is located within the recess, the door is opened and in a stop position state.

11. An automatic fire door closing system, comprising a plurality of automatic fire door closing devices according to claim 10 and a central control room, wherein the fire monitoring and response devices and the state monitoring devices of the plurality of automatic fire door closing device being in communication with the central control room, and the central control room being configured to receive open/close state signals of each door sent out by respective state monitoring devices and send driving signals to respective fire detectors to cause the clamping device release the rotating shaft.

* * * * *